United States Patent [19]

Rutkowski et al.

[11] 4,435,938

[45] Mar. 13, 1984

[54] VINYL SIDING ATTACHMENT

[75] Inventors: Edward J. Rutkowski, Kenmore; Thomas R. Krowl, North Tonawanda, both of N.Y.

[73] Assignee: National Gypsum Company, Dallas, Tex.

[21] Appl. No.: 320,613

[22] Filed: Nov. 12, 1981

[51] Int. Cl.[3] ..... E04D 1/00

[52] U.S. Cl. ..... 52/521; 52/546

[58] Field of Search ..... 52/521, 520, 543, 546

[56] References Cited

U.S. PATENT DOCUMENTS

| | | | |
|---|---|---|---|
| 2,588,673 | 3/1952 | Tyson | 52/546 |
| 3,738,076 | 6/1973 | Kessler | 52/546 X |
| 4,047,349 | 9/1977 | Aguilar, Jr. | 52/546 X |

*Primary Examiner*—Philip C. Kannan

*Attorney, Agent, or Firm*—Robert F. Hause

[57] ABSTRACT

Clips, which are rigidly affixed to a structure, are loosely affixed to vinyl siding by elements grasping the siding nailing portion.

5 Claims, 4 Drawing Figures

VINYL SIDING ATTACHMENT

This invention relates to the attachment of thin vinyl siding, and particularly to the use of clips which can be affixed to a structure and inherently provide the desired relatively loose holding of the vinyl siding, permitting freedom of the siding to expand and contract with changes in temperature.

Extruded sections of thermoplastic polyvinyl chloride siding, commonly referred to as vinyl siding, with face sections of about one millimeter thickness, are commonly used as an imitation and substitute for wooden lap siding. One problem that is common with vinyl siding is its tendency to expand and contract with changes in temperature.

As a result it has been a practice to attach vinyl siding by nailing, through nail slots provided, with the nails never driven all the way in. The nails were stopped short, in driving them in, sufficient to permit the siding to move sideways relative to the nails. Ribs are commonly formed in the nailing portion of the siding, having a height which is contacted by a hammer head, when the nail has been driven in far enough, and further driving of the nail becomes undesirable.

Although these nailing ribs are generally effective in reminding an applicator to not drive a fastener in tight against the siding, they are only reminders and are not positive in the prevention of tight fastening. They are not effective in preventing tight fastening when fasteners are applied by power tools, such as a rapid power nailer.

The present invention adds a clip to the structure which is constructed to grasp the nailing portion, along the top edge, of the commonly available forms of vinyl siding, in a way in which no care need be taken regarding providing the ability of the siding to expand and contract relative to the rest of the structure.

It is an object of the invention to provide an improved system for attaching vinyl siding.

It is a further object to provide a means for attaching vinyl siding which inherently always permits freedom of the vinyl siding to expand and contract without distortion.

These and other objects and advantages of the invention will be more readily understood when considered in relation to the preferred embodiments, as set forth in the specification and shown in the drawings, in which.

Figure 1:
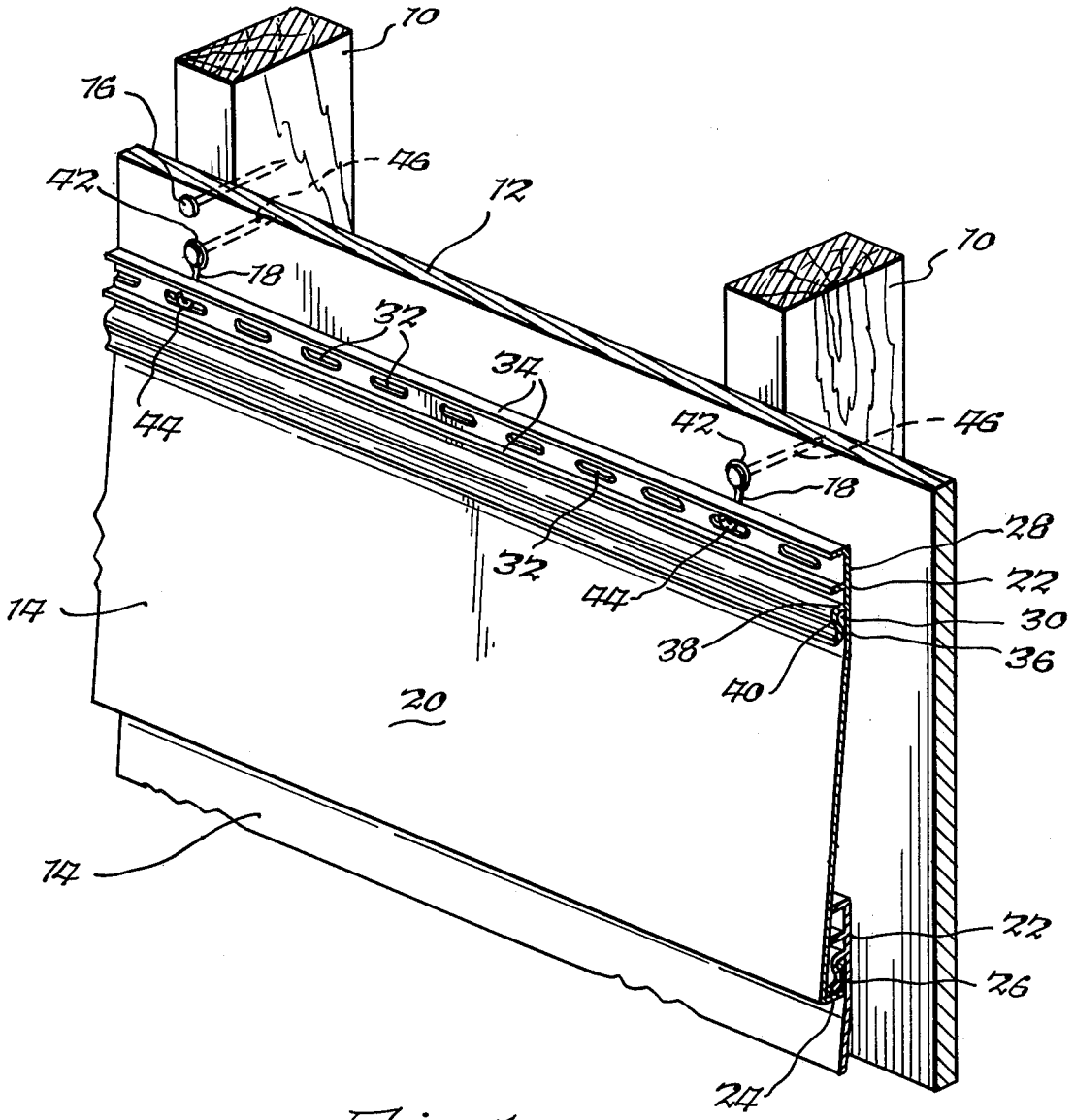
FIG. 1 is an isometric view of two sections of vinyl siding applied to the side of a building in accordance with the invention.

Referring to FIG. 1, there is shown framing members 10, exterior sheathing 12 and two courses of extruded vinyl lap siding 14, which together form the exterior of a building. Sheathing 12 is attached to the framing members 10 with nails 16. Vinyl siding 14 is affixed to the sheathing 12 by clips 18.

Vinyl siding 14 is produced by extruding elongate integral sections of about 10 to 20 feet in length, having a shape to simulate wood lap siding. The siding 14 includes a main face portion 20, a top concealed portion 22 and a bottom perpendicular spacer flange 24 and, at the outermost end thereof, an upwardly extending short interlock flange 26.

The top concealed portion 22 includes an upper attachment portion 28 and a lower interlock receiver channel 30, opening downwardly, for the reception of an interlock flange 26 of the siding section 14 located immediately thereabove. The attachment portion 28 includes a plurality of spaced apart, longitudinally aligned, elongated nailing slots 32. Slots 32 are disposed between two spaced, parallel guide ribs 34, provided to assist an applicator, while nailing, to prevent driving the nail in until it is tight. When applied, the siding should be free to move laterally, relative to the nails, when expansion and contraction of the attachment portion tend to cause some movement.

The interlock receiver channel 30 is formed of an "h" section, in which the long leg 36 connects the attachment portion 28 to the face 20, and a short horizontal leg 38 and an outer downward leg 40 coact with the long leg 36 to form the downwardly opening channel 30.

Typically, the face portion 20 is about eight to ten inches wide, the long leg 36 is about three-fourths of an inch wide and the attachment portion 28 is about a half inch wide. The nailing slots are about 5/32" wide and one inch long, with a spacing of one inch between adjacent slots.

In accordance with one form of the invention, clip 18 consists of a preformed rigid bent wire having a nail receiving loop 42 at the top and an outwardly and reversely bent hook 44 at the bottom, terminating in upwardly extending rigid means for retaining the siding on the bottom portion. Clip 18 is affixed to the sheathing 12 by a nail 46 in loop 42. Hook 44 extends from the sheathing side of the vinyl siding through a nailing slot 32. The wire from which hook 44 is formed is of any diameter smaller than the width of slot 32, permitting the top portion of the siding to move relative to the hook 44, when the siding expands and contracts due to temperature changes.

Figure 2:
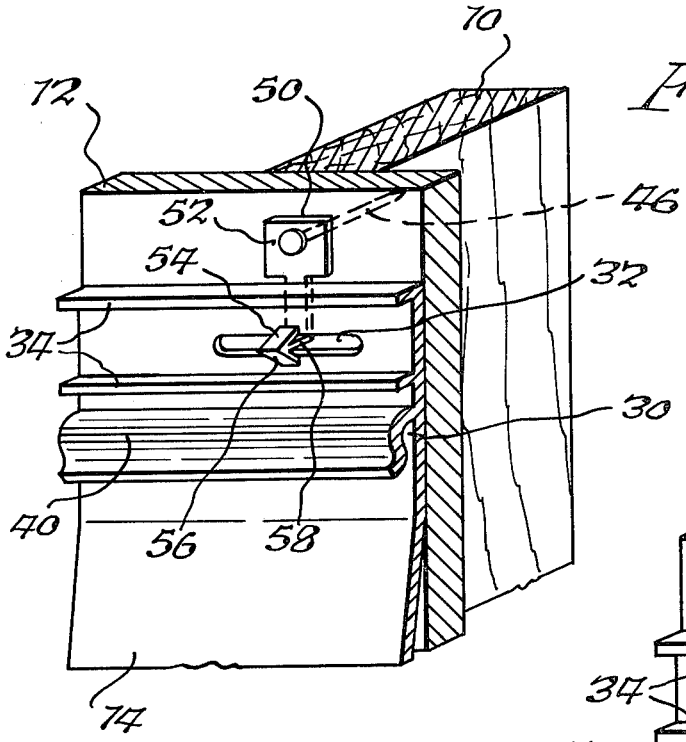
FIG. 2 is an isometric view of a section of vinyl siding applied to a building in a modified form of the invention.

FIG. 2 shows a modified clip 50 formed from semi-rigid plastic, by extrusion or injection molding. Clip 50 includes a back plate 52 and a forwardly extending arrow portion 54. Arrow portion 54 includes a pointed wide head 56, slightly wider than nailing slots 32, and a neck 58, which is narrower than nailing slots 32. Head 56 is inserted through a nailing slot 32, providing a firm retention of siding 14, while permitting the siding to move relative to clip 50.

Figure 3:
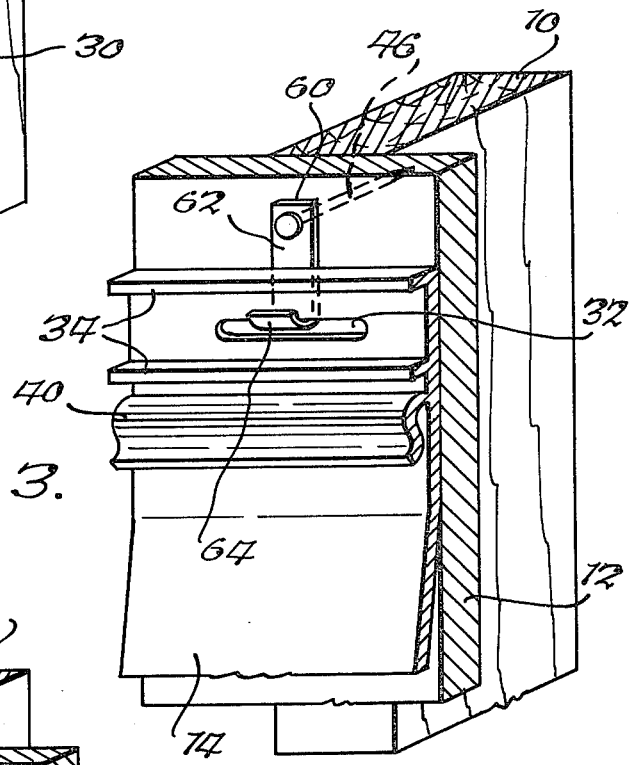
FIG. 3 is a further modified form, similar to the view of FIG. 2.

FIG. 3 shows a further modified clip 60 formed from sheet metal or semi-rigid extruded plastic. Clip 60 is formed with a J-shaped end view, including a flat back plate 62 and a lower hook portion 64. Hook portion 64 is inserted through a nailing slot 32, providing support for siding 14, while permitting the siding to move relative to clip 60.

Figure 4:
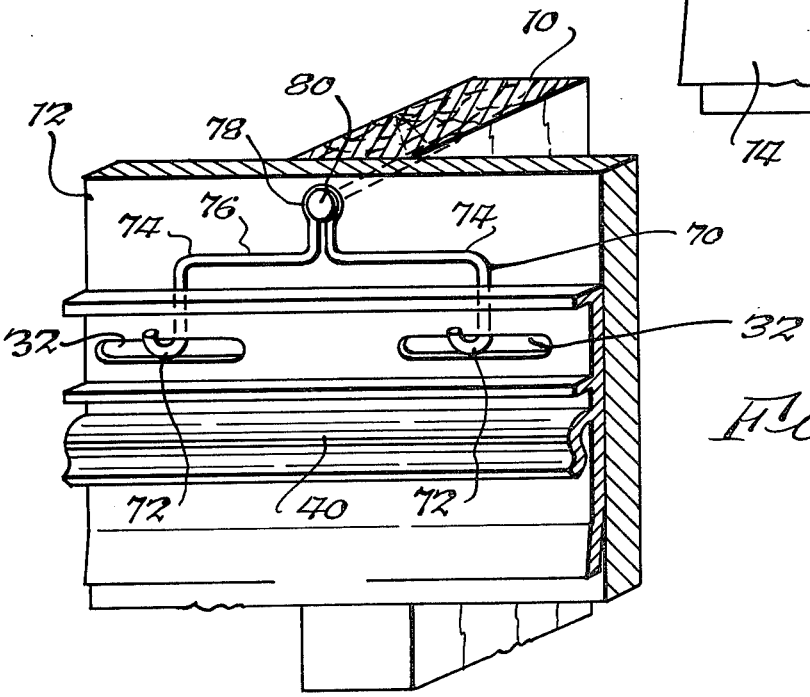
FIG. 4 is a still further modified form, similar to the view of FIG. 2.

FIG. 4 shows a still further modified clip 70, formed from relatively rigid wire. Clip 70 has two hook portions 72 located at each of two ends 74 of a central cross wire 76. A loop 78 is formed in the center of cross wire 76. The two hook portions 72 are spaced apart a distance equal to the center-to-center spacing of the nailing slots 32 in siding 14. The hook portions 72 are inserted through two adjacent nailing slots 32, 32, and loop 78 is affixed against sheathing 12 by a nail 80.

The clips 18, 50, 60 and 70, in each embodiment, will be seen to be used for supporting solely a thin section of vinyl siding.

Having completed a detailed description of the preferred embodiments of our invention so that those skilled in the art may practice the same, we contemplate that variations may be made without departing from the essence of the invention:

We claim:

1. In an exterior wall structure, a plurality of sections of elongate vinyl lap siding, said vinyl siding comprising an elongate thin face section of potentially deformable vinyl exposed and forming the exterior surface of said wall structure and an elongate concealed top portion along the top edge, said top portion having a plurality of holes for the reception of fasteners at spaced positions therealong, and a plurality of preformed, relatively rigid, individual clips, said clips supporting solely a thin section of vinyl siding, said clips each having a top portion and a bottom portion, said clip top portions being affixed to the structure sheathing or framing members, said clip bottom portions having outwardly directed portions extending from behind the siding through said holes terminating in a preformed relatively rigid upwardly extending means for retaining the siding on said clip bottom portions, said clip bottom portions fitting loosely through said holes, whereby the vinyl siding top portion is free to expand and contract relative to said clips when said siding is subjected to temperature changes.

2. In an exterior wall structure, as defined in claim 1, a clip formed of wire, having a fastener receiving loop at the top and at least one downwardly suspended hook portion.

3. In an exterior wall structure, as defined in claim 2, a wire fastener having two downwardly suspended, spaced apart hook portions, said hook portions being spaced apart a distance equal to the center-to-center spacing of said siding holes.

4. In an exterior wall structure, as defined in claim 1, a clip formed of a semi-rigid plastic, comprising a back plate and an outwardly directed arrow portion, said arrow portion including a pointed wide head which is wider than the corresponding dimension of said siding hole and a narrow neck which is loosely disposed within a siding hole.

5. In an exterior wall structure, as defined in claim 1, a clip formed of a thin flat material having a side sectional J-shape.

* * * * *